US005518230A

United States Patent [19]

Scarlata et al.

[11] Patent Number: 5,518,230

[45] Date of Patent: May 21, 1996

[54] STACK HEIGHT SENSING MACHANISM

[75] Inventors: Richard F. Scarlata, Rochester; Jose J. Soler; W. Bradford Willard, both of Fairport, all of N.Y.

[73] Assignee: Xerox Corporation, Stamford, Conn.

[21] Appl. No.: 331,447

[22] Filed: Oct. 31, 1994

[51] Int. Cl.[6] ..... B65H 29/00

[52] U.S. Cl. ..... 271/186; 271/187; 271/155; 271/215; 271/217

[58] Field of Search ..... 271/185, 186, 271/187, 214, 215, 217, 153, 154, 155

[56] References Cited

U.S. PATENT DOCUMENTS

| | | | |
|---|---|---|---|
| 3,722,879 | 3/1973 | Johnston et al. | 271/217 |
| 3,785,638 | 1/1974 | Beazley | 271/155 |
| 3,968,364 | 7/1976 | Miller | 271/215 |
| 4,230,312 | 10/1980 | Templeton | 271/215 |
| 4,469,320 | 9/1984 | Weathe, Jr. | 271/98 |
| 4,501,418 | 2/1985 | Ariga et al. | 271/186 |
| 4,589,645 | 5/1986 | Tracy | 271/3.1 |
| 5,098,080 | 3/1992 | Arone | 271/187 |
| 5,145,167 | 9/1992 | McGraw et al. | 271/186 |
| 5,172,904 | 12/1992 | Sze et al. | 271/187 |

FOREIGN PATENT DOCUMENTS

| | | | |
|---|---|---|---|
| 0162674 | 6/1989 | Japan | 271/215 |

*Primary Examiner*—H. Grant Skaggs
*Attorney, Agent, or Firm*—William A. Henry, II

[57] ABSTRACT

An active stack height sensing mechanism that operates through a cam off a disc stacker which performs one cycle per sheet stacked. After a sheet is stacked, a stack height clamp contacts the stack and stops. If the stack height is too low or within a predetermined range, a flag attached to the clamp will block a light beam path between an emitter and receiver and trip the stack height sensor. If the stack height is too high, the stack height sensor will not be made indicating that the stacker should be indexed down.

15 Claims, 11 Drawing Sheets

STACK HEIGHT SENSING MACHANISM

FIELD OF THE INVENTION

This invention relates generally to an electrophotographic printing machine, and more particularly concerns a stack height sensing mechanism for use with a copy sheet stacking apparatus of such a machine.

BACKGROUND OF THE INVENTION

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the change thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. The copy sheets are collected in a stacking tray or bound or stapled together into sets of copy sheets. The bound or stapled sets of copy sheets are then stacked for presentation to the machine operator.

In commercial high speed printing machines of the foregoing type, large volumes of copy sheets are fed onto a stacking tray with the height of the stack in the stacking tray being maintained at a predetermined height by a conventional passive through beam stack height sensor. The drawback with this system is that only the high point of the stack is actually sensed and it is very costly to sense the entire stack. It is desirable to sense functional points on the stack and to do so, an active sensor system that actually touches and measures the stack height at selected spots is needed.

Conventional stack height sensors include not only non-contact optical, pneumatic or capacitive sensors, but also mechanical contact sensors. Existing optical sensors, including those utilizing reflective optics, are susceptible to contamination, variation of sensitivity due to paper type, color, curl, stack density, and location of the sheets at positions other than at the calibrated focal point of the sensor. Conventional mechanical feeler type stack sensors typically utilize a rigid finger element which is indexed into and out of engagement with the top of the stack. While these devices perform adequately, the mechanical assemblies used to index and reposition the sensing arm are relatively complex. The complexity, in turn, directly effects the overall cost and reliability of the apparatus. Also, many of the contact type stack height sensors are suitable for stacks fed from the bottom. In many application, e.g., printer disc stackers, the paper or other sheet member descends onto the stack. Such applications would effectively rule out the use of certain types of conventional contact sensors and, prior to the present invention, would have required the more costly and optical or pneumatic sensors.

Hence, there still exists the need for relatively low cost, but reliable stack height sensing apparatus that can be readily integrated with the input mechanism that feeds sheets into a stacker apparatus of a printer.

Various approaches have been devised for sensing stack heights and maintaining a predetermined copy sheet stack height. The following disclosures appear to be relevant:

U.S. Pat. No. 4,469,320

Patentee: Wenthe, Jr.

Issued: Sep. 4, 1984

U.S. Pat. No. 4,589,645

Patentee: Tracy

Issued: May 20, 1986

U.S. Pat. No. 5,098,080

Patentee: Arnone et al.

Issued: Mar. 24, 1992

U.S. Pat. No. 5,145,167

Patentee: McGraw et al.

Issued: Sep. 8, 1992

U.S. Pat. No. 5,172,904

Patentee: Sze et al.

Issued: Dec. 22, 1992

The relevant portions of the foregoing patents are included herein by reference along with the references cited therein and may be summarized as follows:

Wenthe, Jr.(U. S. Pat. No. 4,469,320) discloses a feeder that feeds sheets from the bottom of a sheet stack on a stack support and a dual mode stack height sensor which in a first mode controls a variable pneumatic feed means in response to sensing the height of the sheet stack and in a second mode provides a signal indicative of the feeding from the stack support of all of the sheets in the stack. A finger member is resettable on top of the sheet stack and a first switch is actuable by a first position of the finger member to increase the output of an air knife for assisting the bottom feeder when the finger member is reset on top of the sheet stack and the height of the sheet stack exceeds a preset level. A second switch is actuable for a second mode by the dropping of the finger member into a second position in response to all of the sheets being fed out from under the finger, and a feed sheet counter is connected to control the same variable pneumatic control so as to override the first mode control from the sheet stack sensor if a number of sheets is counted exceeding a preset count before the second mode signal.

Tracy (U.S. Pat. No. 4,589,645) describes a stack height sensing system for a recirculating document handler for a copier that includes a set separator finger and two spaced switch means positioned to be variably actuated in response to variable positions of the set separator finger, and control means for providing a number of different controls in response to different combinations of sensed actuations or non-actuations of the two spaced switch means and the operating times at which the combinations of actuations or non-actuations are sensed.

Arnone et al. is directed to a stack height sensor for stacked sheets that includes a switch having an actuator arm positioned adjacent to the top edge of the stack at a predetermined height. The switch has an actuator element positioned adjacent a top edge of the stack at the predetermined height. A resilient stack contacting element is includes that is movable in a direction substantially parallel to the surface of the top sheet in the stack, along a path from a first position engageable with the tip sheet of the stack, across the stack top edge, and to a second position past the switch actuator arm.

McGraw et al. describes a disc stacker that includes a trail edge transport belt for stacking short and long sheets. An elevator platform receives sheets from the disc stacker and is maintained at a predetermined position by a stack height sensor.

Sze et al. discloses a sheet stacking apparatus that employs a rotatable disc that receives each sheet in a slot thereof and inverts each sheet. A transport belt is positioned closely adjacent one surface area of the disc and has a portion thereof positioned at an acute angle with respect to a line tangent to the one surface of the disc so that the trail edge of all sheets being inverted by the disc contact the belt and are inverted. A stack height sensor is used to control the movement of a platform so that the tip of the stack remains at substantially the same level.

SUMMARY OF THE INVENTION

In accordance with an aspect of the present invention, there is provided a printer having a sheet stacking apparatus that is capable of stacking a wide variety of copy sheet sizes and weights. The sheet stacking apparatus includes means for stacking flimsy, light weight, low beam strength sheets in the form of a plurality of belts entrained around a drive roll and two idler rolls. The belts are positioned so that they are contacted by a sheet while the sheets are being driven by input nips and a sheet inversion disc stacker that rotates one revolution per sheet. After the trail edge of the sheet exits the input nips, the belts unroll the sheet for stacking purposes. An active stack height sensing mechanism that maintains the sheet stack height at a predetermined level is included and operates through a cam off the disc stacker. After a sheet is stacked, a stack height clamp is brought down onto the top of the stack by movement of the cam. If the stack height is too low or just right, a flag attached to the clamp makes a sensor. If the stack is too high, the sensor will not be activated indicating that the stacker would be indexed down.

Other aspects of the present invention will become apparent as the following description proceeds and upon reference to the drawings in which.

While the present invention will hereinafter be described in connection with preferred embodiments, it is intended to cover all alternatives, modifications, and equivalents, as may be included within the spirit and scope of the invention as defined by the appended claims.

Figure 1:
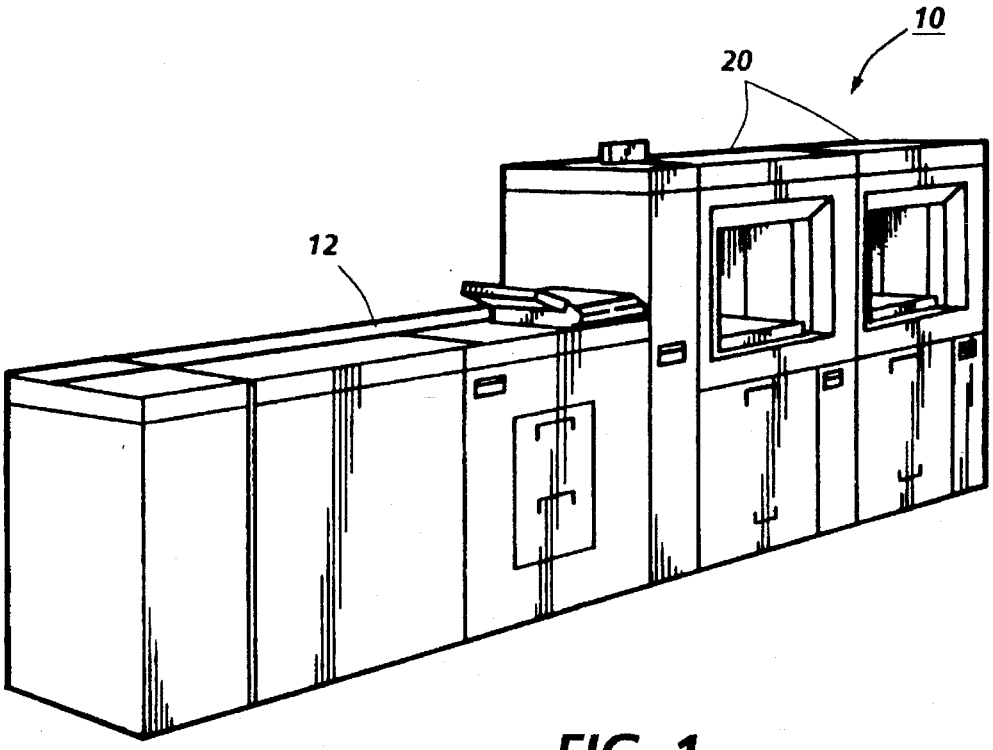
FIG.1 is an isometric view of a printing machine incorporating a sheet stacking apparatus with the stack height sensing mechanism of the present invention.

For a general understanding of the features of the present invention, reference is made to the drawings. In the drawings, like reference numeral shave been used throughout to identify identical elements, FIG. 1 schematically depicts an electrophotographic printing machine incorporating the features of the present invention therein. It will become evident from the following discussion that the stack height sensing mechanism of the present invention may be employed in a wide variety of devices and is not specifically limited in its application to the particular embodiments depicted herein.

DETAILED DESCRIPTION OF THE PREFERRED EMBODIMENT

Figure 2:
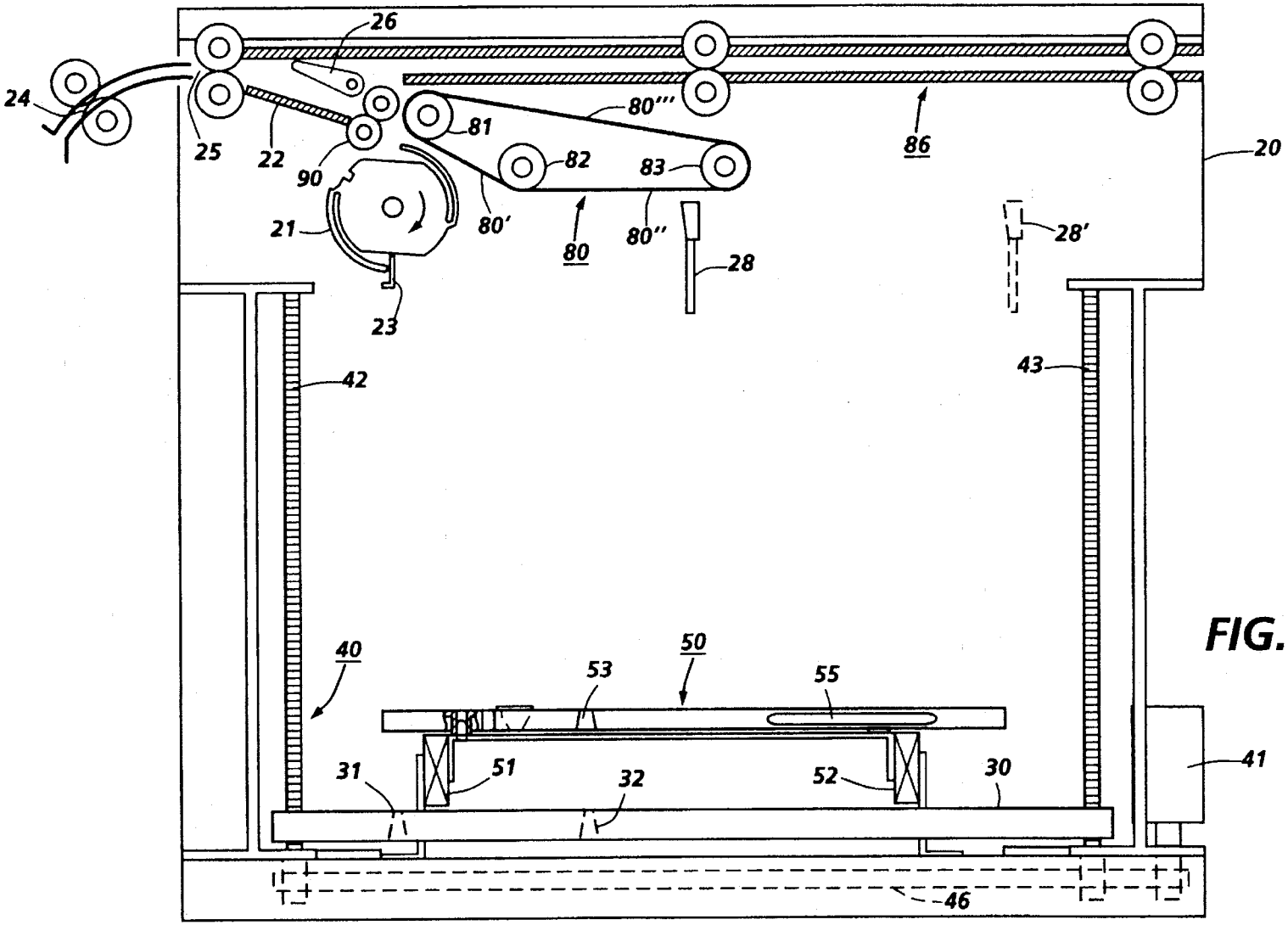
FIG. 2 is a side view of the sheet stacking apparatus of FIG. 1 incorporating the stack height sensing mechanism of the present invention and showing a main pallet in its home position.

FIGS. 1 and 2 illustrate a feeder/stacker 10 which includes two sheet stackers 20 according to the present invention. Feeder portion 12 can be, for example, a conventional high speed copier or printer. One type of system usable as feeder portion 12 can include an optical scanner for digitizing data contained on original documents and supplying the digitized data to a high speed, high quality printer such as a laser printer which outputs documents to the sheet stackers 20. Each sheet stacker 20 includes one or more rotating discs 21 of the type disclosed in U.S. Pat. Nos. 5,065,996 and 5,145,167 which are included herein by reference. Disc 21 includes one or more slots for receiving sheets therein. Rotating disc 21 then rotates to invert the sheet and register the leading edge of the sheet against a registration means or wall 23 which strips the sheet from the rotatable disc 21. The sheet then drops to the top of the stack of inverted sheets which are supported on either a main pallet 50 or container pallet 58, both of which are vertically movable by elevator 30. An overhead trail edge assist belt system 80, to be described in more detail below, is located adjacent the rotatable disc 21 and above elevator platform 30 to assist in the inversion of sheets. Elevator platform 30 is moved in a vertical direction by the actuation of a screw drive mechanism 40. The screw drive mechanism includes a separate, vertical, rotatable shaft having a threaded outer surface at each corner of the elevator platform and extending through a threaded aperture therein (four vertical shafts in total). As the vertical shafts 42–45 are rotated by motor, platform 30 is raised or lowered. A stack height sensor 100, described below, is used to control the movement of platform 30 so that the top of the stack remains at substantially the same level. Each stacker 20 also includes a tamping mechanism (not shown) which is capable of offsetting sets of sheets in a direction perpendicular to the process direction.

The provision of more than one disc stacker 20 enables sheets to be outputted at higher speeds and in a continuous fashion. A specific requirement of the high speed computer printer market is the ability to provide long run capability with very minimal down time due to system failures, lack of paper supply, or lost time during unload. By providing more than one stacker, the outputting of documents need not be interrupted when one of the stackers becomes full since documents can merely be fed to the other stacker while the full stacker is unloaded. Thus, should one stacker become filled or break down, the outputting of copy sheets is not interrupted. Furthermore, the bypass capability (deflector 26 and bypass transport 86) of each stacker enables both stackers to be bypassed so that documents can be fed to other downstream devices such as additional stackers or sheet finishing apparatus, such as, for example, folding or stapling devices.

A trail edge guide 28 is positioned and movably mounted so that sheets having different lengths can be accommodated in sheet stacker 20. FIG. 2 illustrates the position of trail edge guide 28 for smaller sheets such as 8½–11" sheets (long edge fed). The position of trail edge guide 28'is shown for sheets that are 11–17" (short edge fed).

Before entering sheet stacker 20, the sheets exit through output nips 24 and 25 of an upstream device. The upstream device could be a printer, copier, other disc stacker, or a device for rotating sheets. Sheets may need to be rotated so that they have a certain orientation after being inverted by disc 21. The sheets can enter disc stacker 20 long edge first or short edge first. After entering stacker 20, the sheet enters predisc transport 22 where the sheet is engaged by the nip formed between one or more pairs of disc stacker input rollers 21. If a bypass signal is provided, bypass deflector gate 26 moves downward to deflect the sheet into bypass transport assembly 86. If no bypass signal is provided, the sheet is directed to disc input rollers 90 which constitute part of the feeding means for feeding sheets to an input position of disc 21.

The movement of the disc 21 can be controller by a variety of means conventional in the art. Preferably, a sensor located upstream of disc 21 detects the presence of a sheet approaching disc 21. Since disc input nip 21 operates at a constant first velocity, the time required for the lead edge of the sheet to reach the disc slot is known. As the lead edge of the sheet begins to enter the slot, the disc rotates through a 180° cycle. The disc 21 is rotated at a peripheral velocity which is about ½ the velocity of input rollers that form input 25 so that the leading edge of the sheet progressively enters the disc slot. However, the disc 21 is rotated at an appropriate speed so that the leading edge of the sheet contacts registration wall 23 prior to contacting the end-of the slot. This reduces the possibility of damage to the lead edge of the sheet. Such a manner of control is disclosed in incorporated by reference U.S. Pat. No. 4,431,177 to Beery et al.

Figure 3:
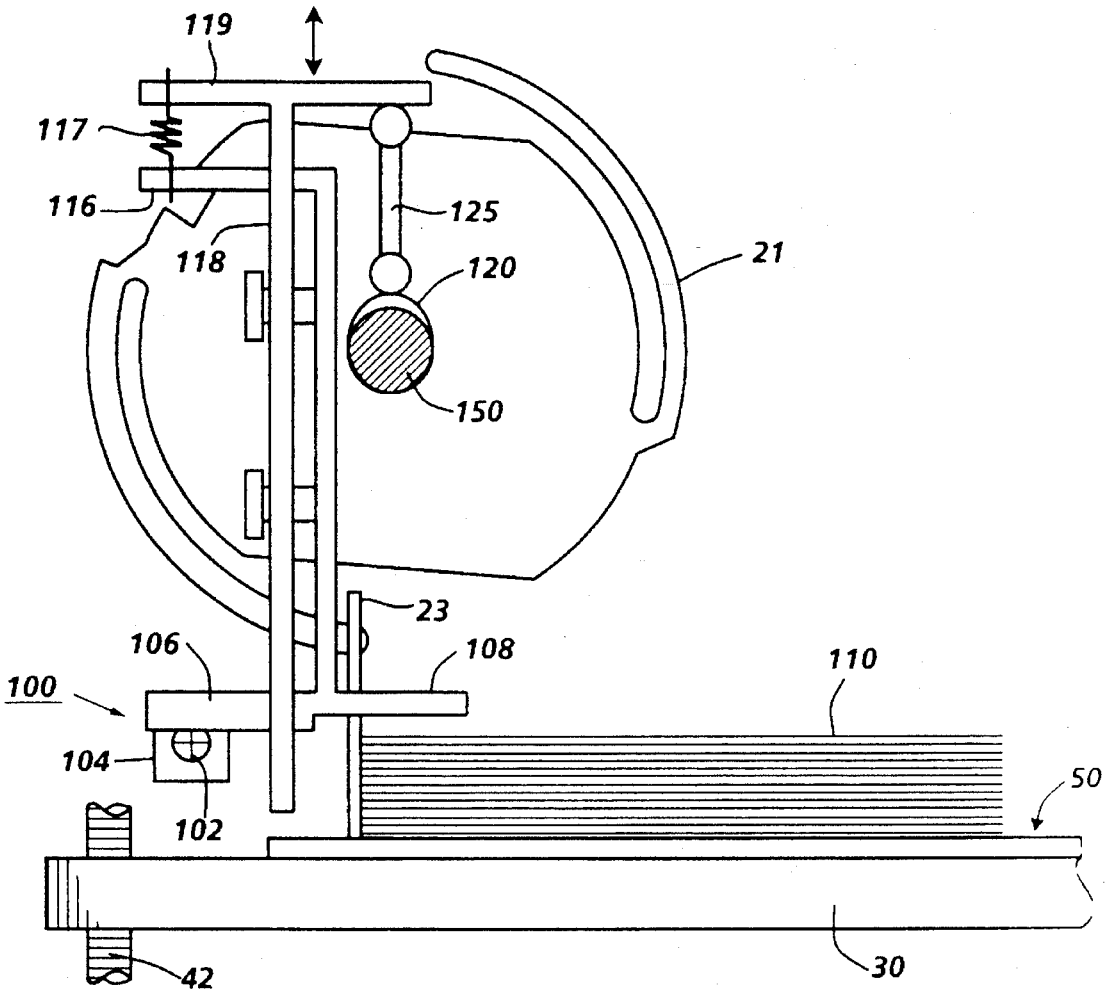
FIG. 3 is an enlarged side view of the stack height sensing mechanism shown in FIG. 2.

One advantageous feature of the present invention involves the construction and operation of stack height sensor mechanism 100 in FIG. 3. As opposed to previous systems which utilized either costly or problem prone through beam stack height sensors or costly and cumbersome feeler type stack height sensors, the present invention includes a low cost, active stack height sensor that actually touches and measures the stack height at selected spots. The stack height sensor 100 works off the mounting shaft 150 of disc 21 and comprises an emitter 102 and a receiver 104 that are connected to a controller (not shown) of printer 10 and positioned in the vertical path of movement of flag member 106. A stack sensing clamp 108 is connected to flag 106 with both members extending in the same plane as sheets in stack 110 and part of movable support member 115. A member 116 extends orthogonally from an end of support member 115 that is remote from sheet stack 110 and has one end of a tension spring 117 attached thereto. Spring 117 has an opposite end attached to a portion 119 of vertically movable member 118. A disc driver cam 120 is attached to disc shaft 150 and is operated off the disc. Cam 120 has a follower member 125 that it pushes upward when rotated and follower member 125 in turn is adapted to contact and press against member 119 to pull spring 117 upward in order to move clamp 108 away from sheet stack 110.

In operation, disc 21 is rotated one revolution per sheet that is stacked and after a sheet is stacked, stack height clamp 108 contacts the stack and stops. If the stack height is too low or just right, flag 106 which is attached to clamp 108 will trip stack height sensor 100 by way of emitter 102 and receiver 104. If the stack is too high, the sensor will not be made, indicating that the stacker should be indexed down. As the next sheet arrives, the disc starts turning, lifting the stack height clamp off the stack, allowing the sheet to register. Near the end of the next revolution of cycle of the disc, the clamp will once again contact the stack. An additional advantageous feature of this system is that it tends to control curl build-up and sheets climbing the registration wall by pressing the stack down as it clamps to sense stack height. Also, this system facilitates active stack height sensing where sheets are dropped onto the stack with disc stacker arrangement 21, where a clamp is constantly in touch with the stack.

A trail edge transport belt 80 includes a trail edge assist belt or belts 80 which are rotated at a velocity which is greater than the velocity at which feeding means (which includes input nips 24 and 25) is operated. Preferably, transport belt 80 is rotated at a velocity which is 1.5 times the velocity of the feeding means. Additionally, trail edge transport belt 80 is arranged at an angle to elevator platform 30 so that a distance between a portion of the transport belt and elevator platform 30 decreases as the transport belt 80 extends away from rotatable disc 30. Three pulleys 81, 82, and 83, at least one of which is driven by a motor (not shown) maintain tension on transport belt 80 and cause transport belt 80 to rotate at a velocity which is greater than that of the feeder means. Transport belt 80 is configured and positioned with respect to disc 21 to ensure that all sheets including lightweight sheets begin to make contact with the belt 80 while each sheet is being driven by input nip 25. After the trail edge exits the input nip, the sheet's velocity will be at the direction required to unroll, the sheet will unroll and force it to not sag away from the transport belt increasing the reliability of the stacker. That is, after the lead edge of the sheet has been inverted by discs 21, a sheet has to unroll its trail edge to finish inverting.

Figure 6:
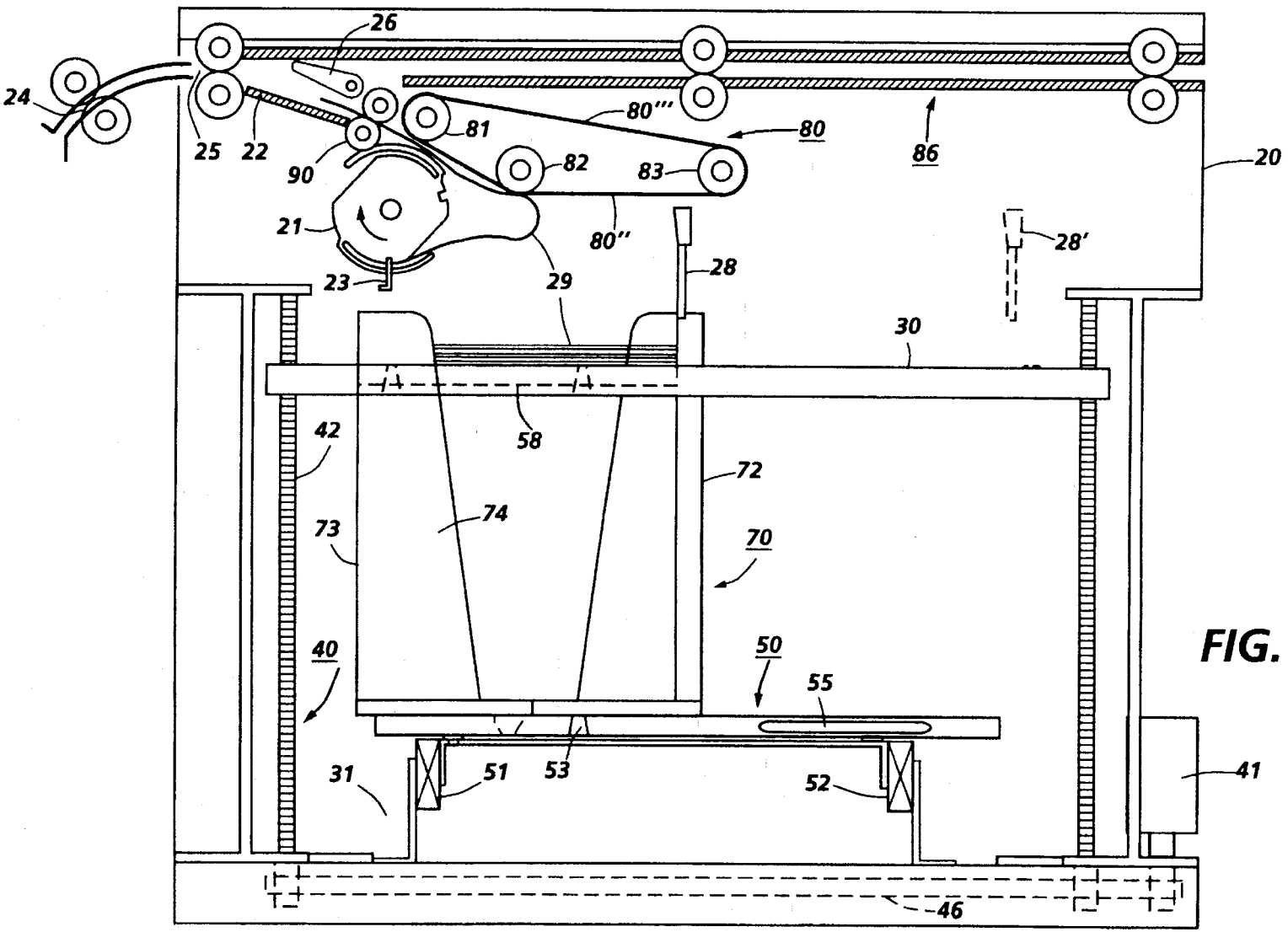
FIG. 6 is a side view of the sheet stacking apparatus of the present invention showing a container on the main pallet with its container pallet lifted into a sheet stacking position by an elevator mechanism.

Belt 80 is configured such that a section 80 thereof is closely spaced with respect to discs 21 and slopes downwardly at a steep angle in a span between rollers 81 and 82 as it extends away from discs 21. The angle of belt 80' is approximately 17 degrees with respect to a horizontal plane through the center of disc 21. The distance from the center of roller 81 to the center of disc 21 is about 65.7 mm vertically and 8.4 mm removed from a vertical plane through the disc. This configuration facilitates control for the sheet in that the sheet contacts the belt while it is still in input rollers 90. A second portion 80" of belt 80 is parallel to the top surface of elevator 30 while a third portion of the belt 80''' is at an acute angle with respect to elevator 30 that is less than the acute angle of slope 80'. With this structural relationship between belt 80 and disc 21, control is maintained over sheets 29 of all sizes and weights because the sheets are forced to contact belt(s) 80 while they are still under the influence of input rollers 90 as shown in FIG. 6 and, as a result, contact with the belt is maintained as the disc is rotated and the sheet continues to unroll as required. Belt 80 is configured as an inverted triangle with the apex 82 of the triangle being downstream from disc 21 and positioned below a plane across the uppermost portion of the disc. A portion of the belt most remote from the disc is an uninterrupted straight span that is angled downwardly with respect to a horizontal plane.

Figure 4:
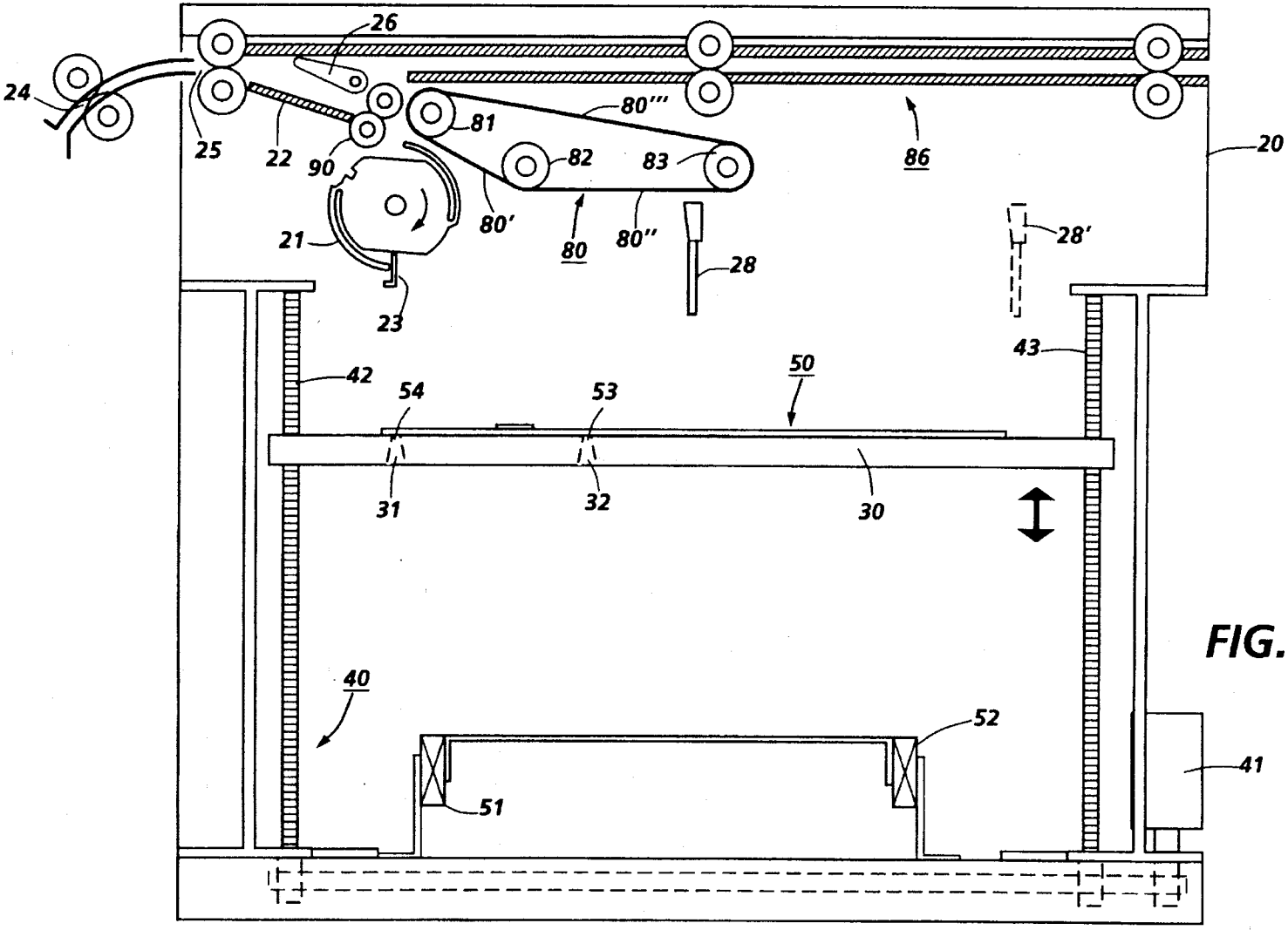
FIG. 4 is a side view of the sheet stacking apparatus of FIG. 2 with the main pallet in a raised position.
Figure 4A:
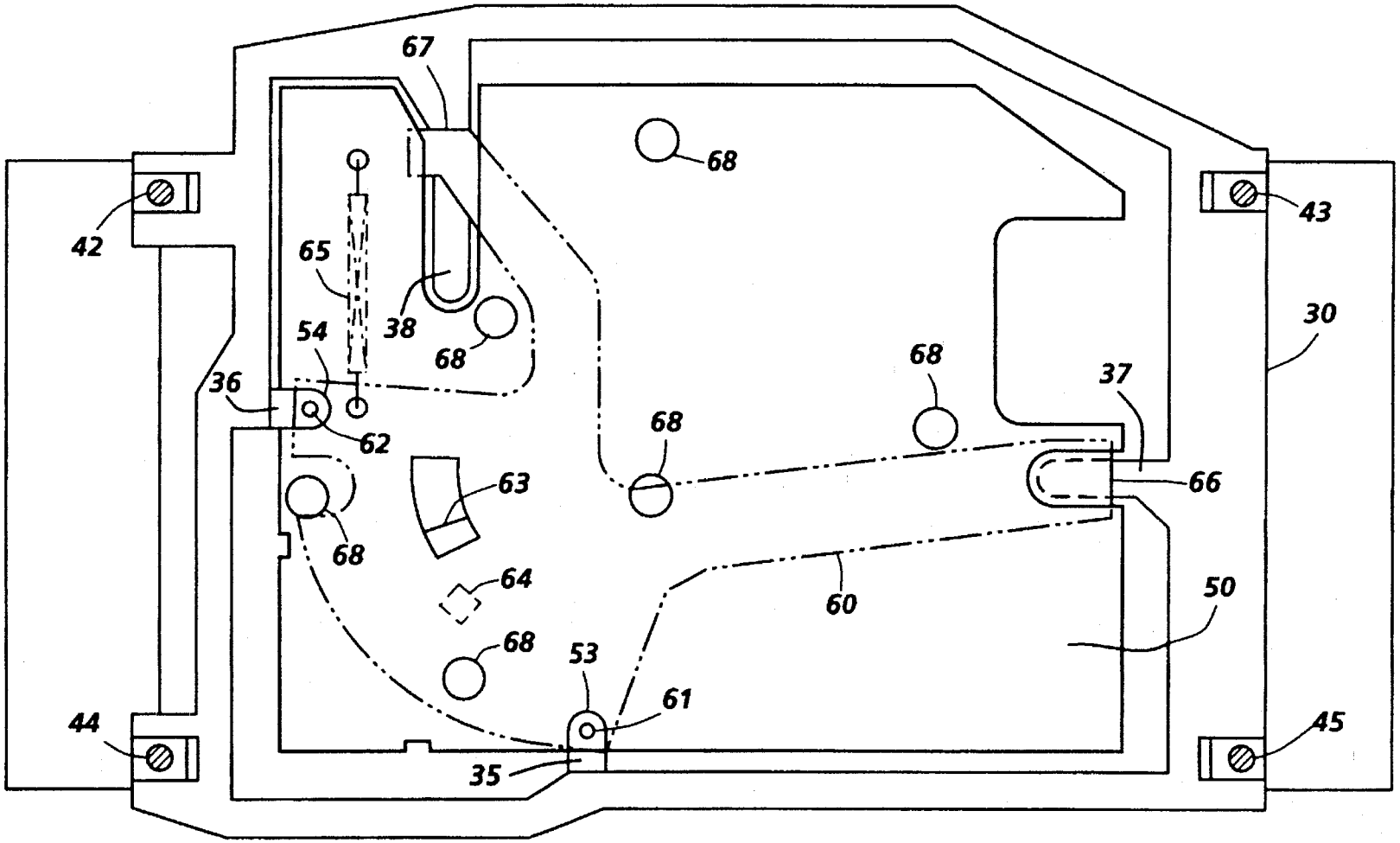
FIG. 4A is a plan view of the sheet stacking apparatus of FIG. 2 showing a spider latch in phantom in an unactivated position which facilitates movement of the main pallet by an elevator mechanism.

As indicated by the arrow in FIG. 4, before the first sheet comes into stacker 20, motor 41 is energized by a conventional controller and raises elevator 30 by way of screws 41, 42, 43 and 44. Elevator 30 has projections 31 and 32 therein that are configured to fit into openings 53 and 54 of main pallet 50 as well as openings 61 and 62 in spider latch 60 when the spider latch is in the unactuated position as shown in dotted lines in FIG. 3A and indicated by pointer 63. Portions 66 and 67 of spider latch 60 are also used to raise the pallet by contacting arms 37 and 38 of elevator 30. Once the main pallet 50 is in its uppermost position, sheets are stacked thereon by disc 21 of stacker 20. As previously described, photosensor 100 that includes an emitter 102 and receiver 104 monitors the sheet stack height and through signals to a controller in printer 12, indexes the pallet downward in response to the receiver being blocked by flag member 106 as clamp 108 touches the top of the sheet stack. When feeding of sheets into stacker 20 is complete, handle 55 is grasped and main pallet 50 is withdrawn from the stacker using rails 51 and 52 and sheets are removed from the main pallet for further processing. While this process is taking place copy sheets are forwarded to a second stacker for stacking.

With continued reference to FIG. 4, there is shown further details of the manner in which elevator 30 is indexed. As shown in FIG. 2, elevator 30 has tray or pallet 50 as in FIG. 6 mounted thereabove for the support of copy sheets. With continued reference to FIG. 4, drive motor 41 is a bidirectional 115 Volt AC motor that raises and lowers elevator 30. A 100 millisecond delay is required before reversing the motor direction. The motor capacitor ensures that the motor starts and runs in the correct direction. In order to protect the motor against damage caused by the complete or partial seizing of the elevator 30, the motor contains an internal sensor. If the motor becomes too hot, the sensor switches off the motor. The thermal sensor resets automatically when the motor cools. When the motor 41 is switched ON in order to raise or lower elevator 30, the elevator 30 is moved by a drive belt 46. One drive belt 46 connects the drive from motor 41 to the four lead screws 42–45. A spring (not shown) attached to the motor and frame applies tension to the drive belt. Elevator 30 is connected to the four lead screws by lift nuts (not shown). Two triacs mounted on a remote board are associated with the motor. One triac is used to raise elevator 30 with the other being required to lower elevator 30. In response to a predetermined signal from stack height switch sensor 100, the control logic sends a 5 volt signal to the triac. The triac then sends AC power to the motor 41 and capacitor and switches ON motor 41 for a predetermined number of milliseconds. Afterwards, the control logic switches off the 5 volt signal to the triac so as to de-energize motor 41. The pitch of the lead screws is selected so that the predetermined millisecond rotation of the lead screws will translate elevator 30 a fixed preselected distance in millimeters.

Figure 10:
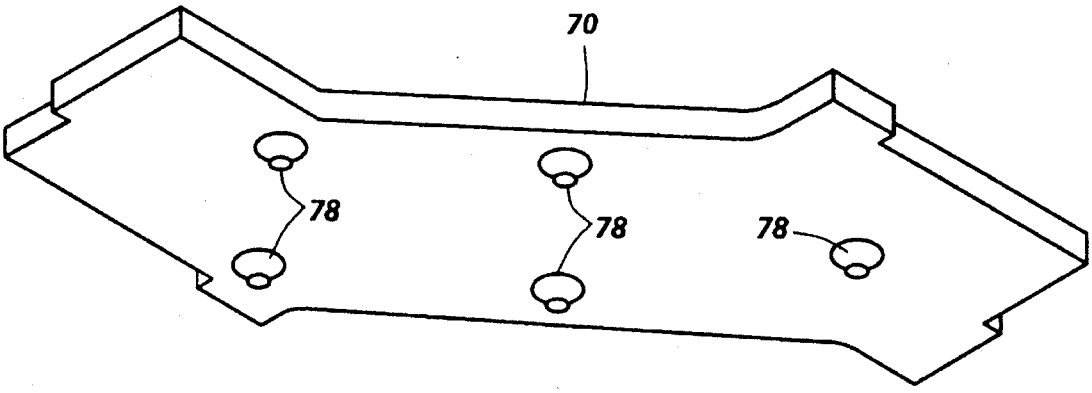
FIG. 10 is a partial schematic isometric view of the container in FIG. 6 showing projections on its bottom surface that mate with complimentary openings in the main pallet.
Figure 5:
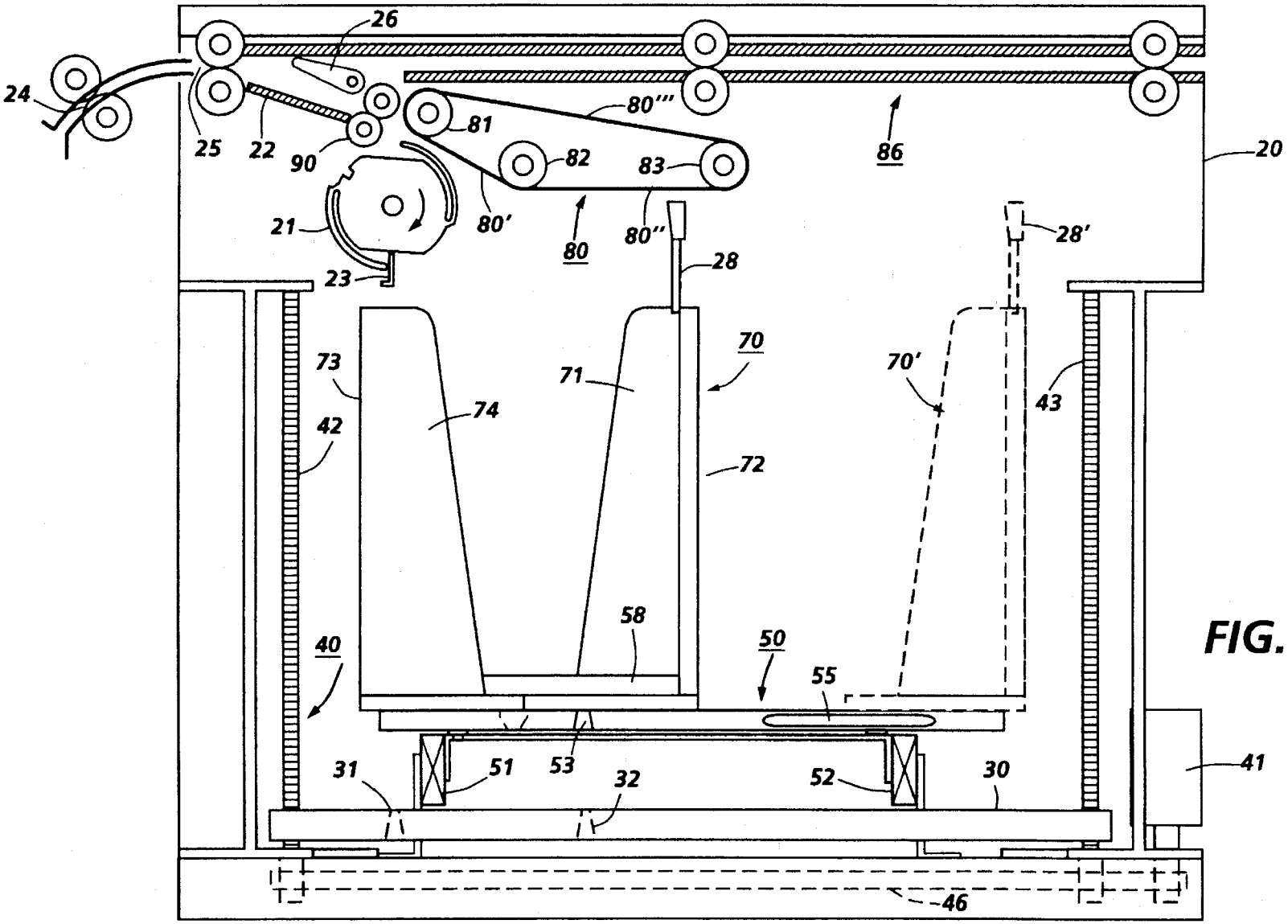
FIG. 5 is a side view of the sheet stacking apparatus of FIG. 2 showing a container for stacking 8½"×11" sheets in solid lines and a container for stacking 11"×17"sheets in dotted lines, both positioned on the main pallet with one showing a container pallet as an insert.
Figure 6A:
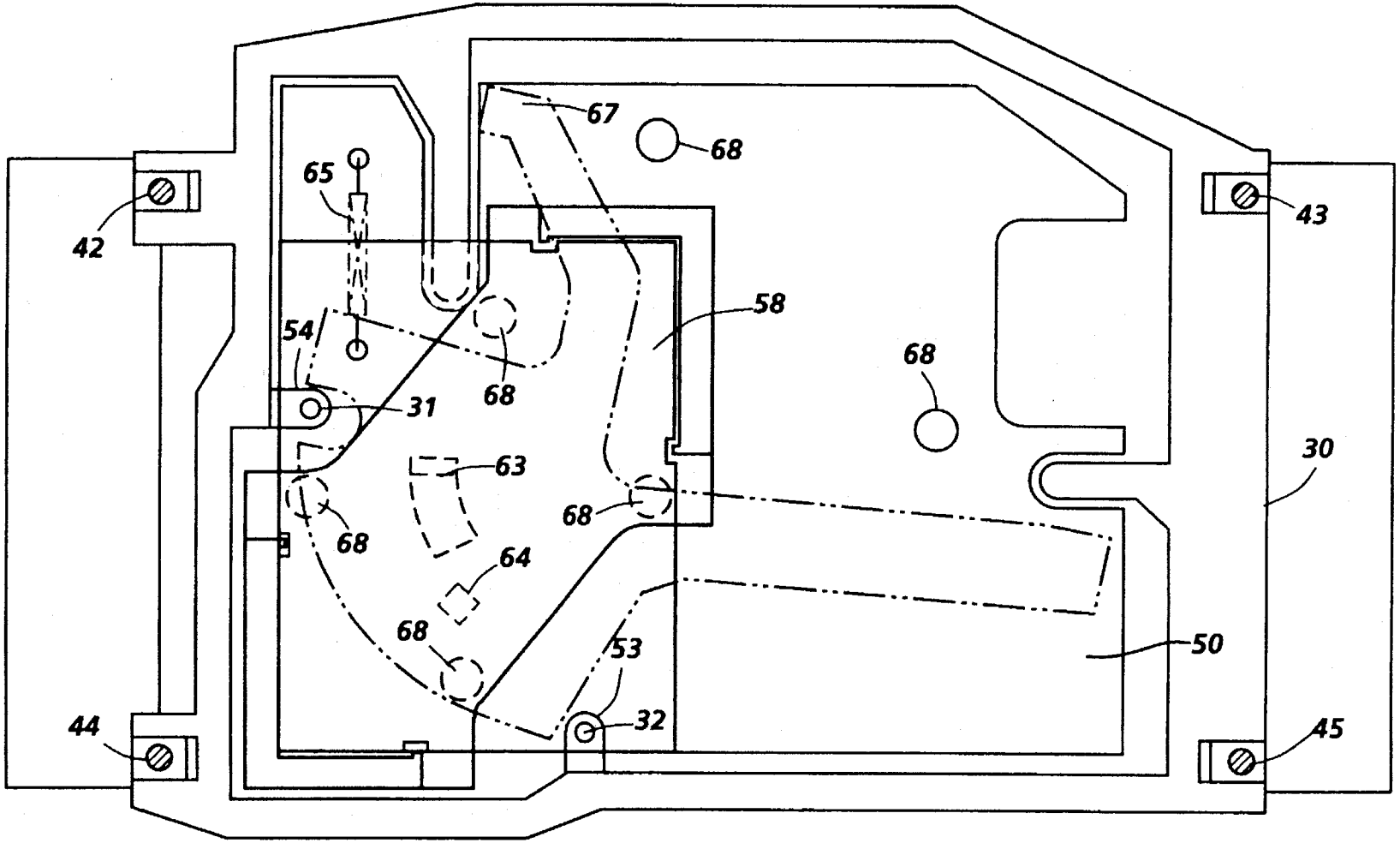
FIG. 6A is a plan view of the sheet stacking apparatus of FIG. 6 showing the spider latch mechanism in its actuated position in phantom which allows the elevator mechanism to lift the container pallet.
Figure 7:
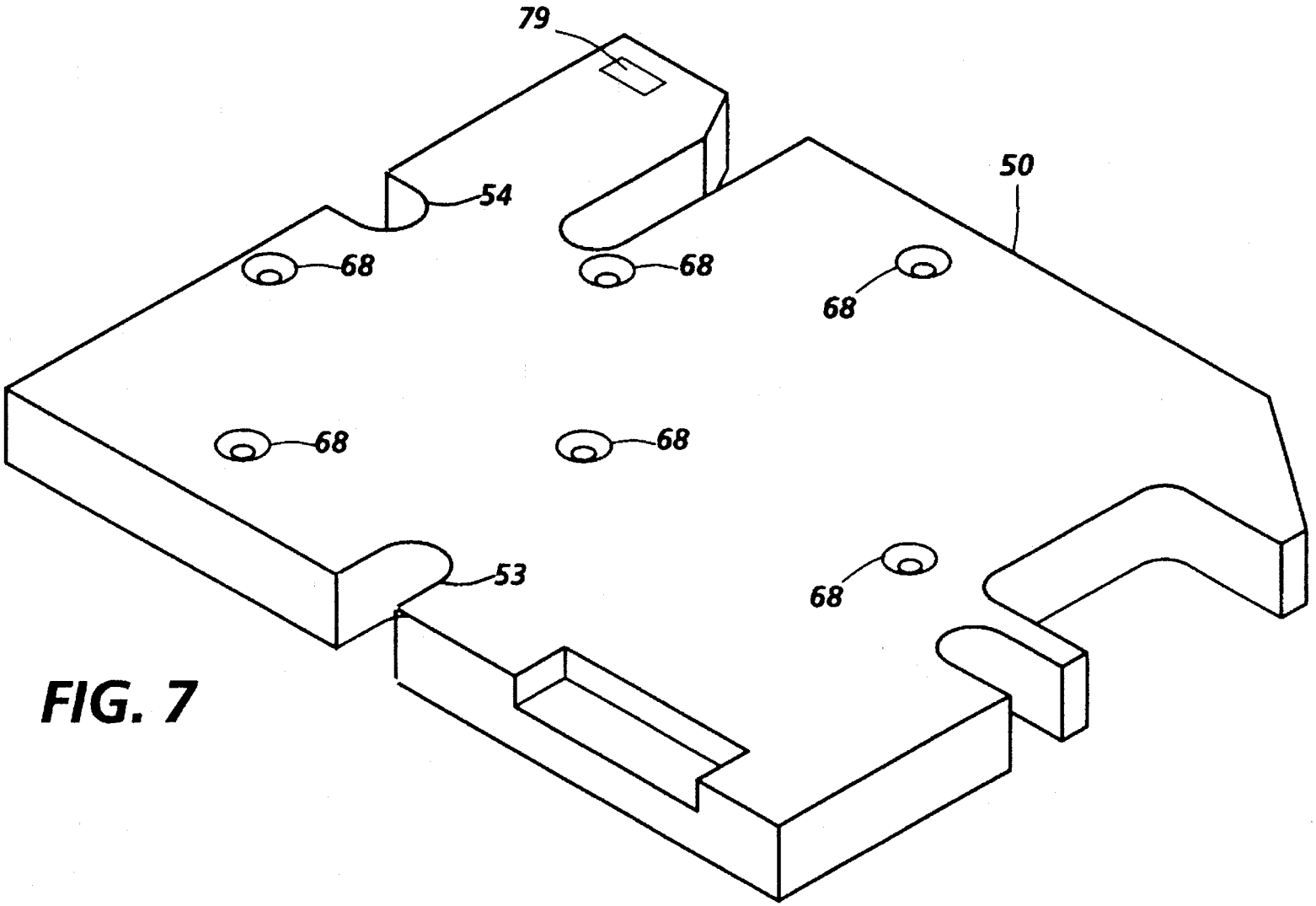
FIG. 7 is a schematic isometric view of the main pallet of the sheet stacking apparatus of FIG. 2.
Figure 8:
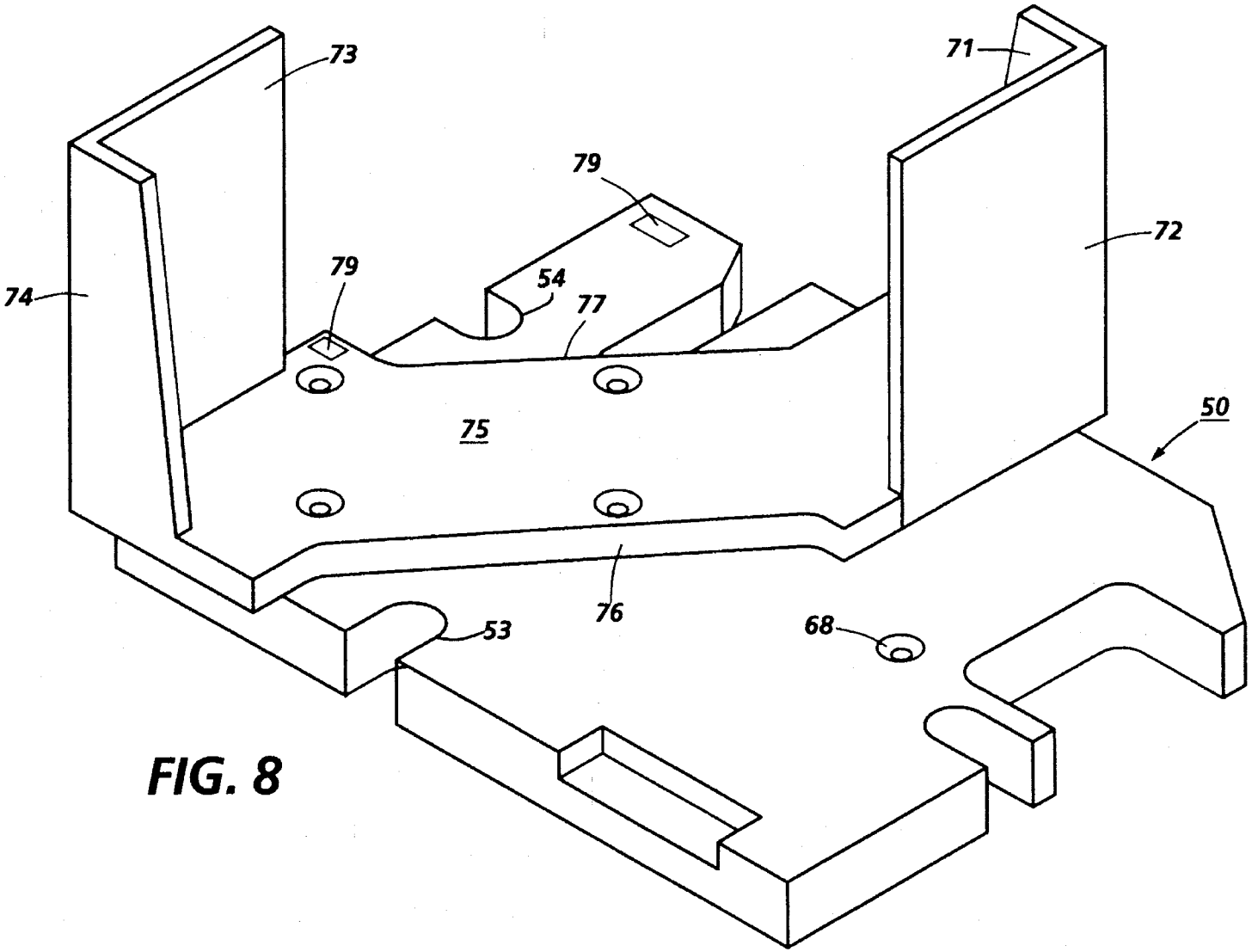
FIG. 8 is a schematic isometric view of a container mounted on the main pallet of FIG. 7.
Figure 9:
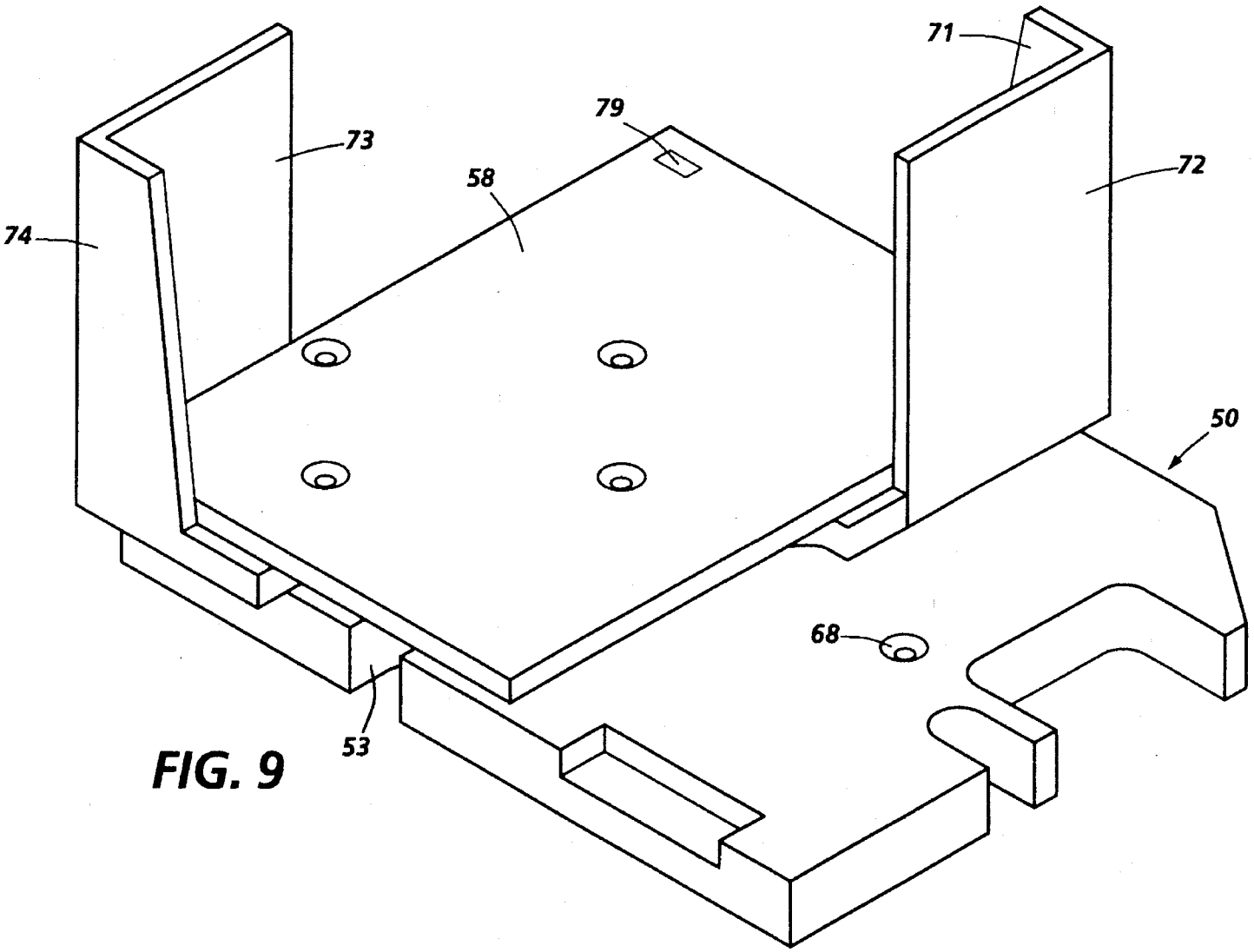
FIG. 9 is a schematic isometric view of a container and container pallet for 8½"×11" sheets mounted on the main pallet.

Alternatively, for ease of removal of a stack of sheets from the main pallet and storage, a container pallet 58 of FIGS. 6A and 8 is placed on top of main pallet 50. Container pallet 58 has projections on the bottom thereof that mate with complimentary openings 68 in main pallet 50. Placing of container pallet 58 onto main pallet 50 will cause the weight of container pallet 58 to actuate spider latch 60 by pressing it out of engagement with ramp 64. Once this happens, spring 65 pulls the spider latch to the dotted line position shown in FIG. 6A and indicated by pointer 63. With the spider latch in this position, elevator 30 will lift the container pallet into position to receive sheets and not the main pallet 50 since arms 35 and 36 will now pass through openings 53 and 54 of the main pallet and contact the bottom of container pallet 58 and lift the pallet to the sheet receiving position. The stacker is emptied by lifting the container pallet off the main pallet. Container pallets are sized according to the size of sheets to be stacked and projections on the bottom of the container pallets fit into those of the openings in the main pallet as appropriate. Spider latch 60 as seen in FIGS. 4 and 6 is rotatably positioned beneath the bottom of main pallet 50 and has a conventional stop member attached thereto (not shown) that is biased by spring 65 into engagement with an end of ramp 64 which is attached to main pallet 50. The spider latch is manually moved back to the position of FIG. 4 after container pallet 58 or a container as shown in FIG. 7 is removed from the main pallet The preferred embodiment of the present invention is shown in FIG. 5, 8 and 9 that includes containers 70 and 70' in position to receive sheets for stacking. Container 70 is sized to receive 8½×17" dotted line container 70' is sized to receive 11×17" sheets. Containers are sized to accommodate sheet sizes from B5 to A3 and each size will fit onto main pallet 50. Each container has a container pallet 58 therein that is lifted to a stack loading position by elevator 30. Each container has magnets attached to one surface thereof that are used to signal the printer's controller as to the size of containers in place. Main pallet 50 and container pallet 58 also have magnets 79 attached thereto that signal the controller while apparatus is being used as a sheet stack support. Container 70 is shown in its unloaded position in FIG. 5 and in position to receive sheets in FIG. 5 with container pallet 58 in a raised position. As seen in FIGS. 6, 6A and 10, container 70 includes a container pallet and has a support surface with relieved areas and only two diametrically opposite corners which provide the advantages over four corner containers of: (1) allowing multiple size containers to be used with the same elevator lift mechanism; (2) allowing improved visibility from any angle for determining stacking progress within the printer by checking the status of the containers (full or empty) outside the printer; (3) providing a symmetrical (identical) corner design which allows one mold for both corners and is common for all container sizes; (4) allows for improved container nesting for storage and shipping; (5) providing separate container floor and corners which allow dissembled shipment for improved nesting; (6) allows for set removal via an open corner instead of lifting copy sheets over the top of the container thereby improving overall operability; and (7) allows access to lift the entire stack of sheets from the container without the use of an unload pedestal as heretofore required.

Container 70 in FIGS. 8 and 9 in order to meet the heretofore mentioned advantages comprises a base support member 75 that has two relieved or cutaway portions 76 and 77 therein leaving only two right angled corners that are opposite each other. Upstanding side members 71, 72, 73 and 74 are connected to the two corners of the base member to allow several reams of copy sheets to be stacked on container pallet 58 which is positioned on base member 75. Each container size, i.e., for 8½×11", 11×17", etc. is oversized by about ½" in order for each copy sheet set including tab stock within the container walls to be offset by conventional side joggers. Sides 71, 72, 73 and 74 each slope downwardly and outwardly from top to bottom to provide open viewing of sheets in the container.

As shown in FIG. 10, container 70 has projections 78 on the bottom surface thereof that mate with opening 68 in the main pallet and releases latch 60 due to the weights of the container on the main pallet. The projections also provide stability and precise, predictable positioning of the container.

It should now be apparent that a stacker apparatus has been disclosed that can handle all sizes of sheets and includes a sensor mechanism that employs synchronized a clamp to compress a sheet stack and measure the height of a sheet stack. The synchronization enables a simple one axis stroke that eliminates more complex two dimensional mechanisms ordinarily required by top stacking devices.

It is, therefore, evident that there has been provided, in accordance with the present invention, an apparatus that fully satisfies the aims and advantages hereinbefore set forth. While this invention has been described in conjunction with a preferred embodiment thereof, it is evident that any alternatives, modifications, and variations will be apparent to those skilled in the art. Accordingly, it is intended to embrace all such alternatives, modifications, and variations as fall within the spirit and broad scope of the appended claims.

We claim:

1. A sheet stacking apparatus for stacking a wide variety of sheet sizes and weights including flimsy sheets, comprising:

rotatable disc mounted on a shaft and having a slot therein for receiving and inverting sheets fed thereinto from a source;

a sheet stack support for receiving the sheets after they have been inverted and forming a sheet stack; and a stack height sensor for maintaining the sheets stacked on said sheet stack support at a predetermined height, said stack height sensor including a stack sensing clamp member having a first portion thereof extending in a vertical plane with respect to sheet stack support and a second portion thereof that extends at all times in a plane parallel with sheets stacked on said sheet stack support, and wherein said stack height sensor includes an emitter and a receiver, and wherein said clamp includes a third portion thereof that extends orthogonal to said first portion of said clamp member and in the same plane as said second portion of said clamp member, said third portion of said clamp member being adapted to block or not block said emitter from said detector.

2. The stacking apparatus of claim 1, including a spring, and wherein said clamp member includes a fourth portion thereof that extends orthogonal to said first portion of said stack sensing clamp member, said spring having one end thereof attached to said orthogonal fourth portion of said stack sensing clamp member and the other end thereof attached to an orthogonal portion extending from a vertical movable member.

3. The stacking apparatus of claim 2, including a cam arrangement having a cam member attached to said shaft on which said disc is mounted, and wherein upon each cycle of said disc said cam member is adapted through said cam arrangement to pull said spring against said fourth portion of said clamp member and thereby move said second portion of said clamp member away from the top sheet in the sheet stack in one portion of the cycle thereof and said third portion of said clamp member in a direction to intercept a light path between said emitter and receiver in another portion of the cycle thereof.

4. The stacking apparatus of claim 3, wherein said sheet stack support is movable in the stack height direction, and a control means is responsive to said stack height sensor for controlling said sheet stack support.

5. The stacking apparatus of claim 4, wherein said control means lowers the position of said sheet stack support a predetermined amount when said third portion of said clamp member does not block the path between said emitter and receiver.

6. A stack height sensor for use with a shaft mounted disc stacker to maintain sheets stacked on a sheet stack support at a predetermined height, comprising: a stack sensing clamp member; a cam arrangement including a cam member operatively connected to said shaft and said clamp member; an emitter; a receiver positioned to receive a light beam from said emitter; and wherein said clamp member has one portion thereof that is adapted to be pressed against sheets stacked on said sheet stack support and another portion thereof adapted to either block or not block the light beam between said emitter and said receiver by said cam arrangement on each cycle of said disc and cam member depending on whether the stack height is within a predetermined minimum.

7. The stack height sensor of claim 6, including a spring adapted to bias said clamp member toward the sheet stack support.

8. The stack height sensor of claim 7, wherein upon each cycle of said disc said cam member is adapted through said cam arrangement to move said one portion of said clamp member against the top sheet in sheet stack and said another portion of said clamp member in a direction to intercept the path between said emitter and receiver.

9. The stack height sensor of claim 8, wherein said sheet stack support is movable in the stack height direction, and a control means is responsive to said stack height sensor for controlling said sheet stack support.

10. The stack height sensor of claim 9, wherein said control means lowers the position of said sheet stack support a predetermined amount when said another portion of said clamp member does not block the path between said emitter and receiver.

11. A printer for printing page image information onto copy sheet and forwarding the copy sheets to a stacker, the printer including a means for generating page image information, a photoconductive means for receiving the page image information, a means for developing the page image information on the photoconductive means, transfer means for transferring the developed page image information from the photoconductive means to copy sheets comprising:

a rotatable shaft;

at least one disc including at least one slot for receiving a sheet therein;

rotating means for rotating said disc;

a sheet stack support for receiving the sheets after they have been inverted and forming a sheet stack; and a stack height sensor for maintaining the sheets stacked on said sheet stack support at a predetermined height, said stack height sensor including a stack sensing clamp member having a first portion thereof extending in a vertical plane with respect to sheet stack support and a second portion thereof that extends at all times in a plane parallel with sheets stacked on said sheet stack support, and wherein said stack height sensor includes an emitter and a receiver, and wherein said clamp includes a third portion thereof that extends orthogonal to said first portion of said clamp member and in the same plane as said second portion of said clamp member, said third portion of said clamp member being adapted to block or not block said emitter from said detector.

12. The stacking apparatus of claim 11, wherein said stack height sensor includes a spring, and wherein said stack sensing clamp member includes a fourth portion thereof that extends orthogonal to said first portion of said stack sensing clamp member, said spring having one end thereof attached to said orthogonal fourth portion of said clamp member and the other end thereof attached to an orthogonal portion extending from a vertical movable member.

13. The stacking apparatus of claim 12, including a cam arrangement including a cam member attached to said shaft on which said disc is mounted, and wherein upon each cycle of said disc said cam member is adapted through said cam arrangement to move said second portion of said clamp member against the top sheet in the sheet stack and said third portion of said clamp member in a direction to intercept a light path between said emitter and receiver.

14. The stacking apparatus of claim 13, wherein said sheet stack support is movable in the stack height direction, and a control means is responsive to said stack height sensor for controlling said sheet stack support.

15. The stacking apparatus of claim 14, wherein said control means lowers the position of said sheet stack support a predetermined amount when said third portion of said clamp member does not block the path between said emitter and receiver.

* * * * *